United States Patent [19]

Jacobs

[11] 4,384,675

[45] May 24, 1983

[54] GASEOUS FLUID PUMP AND LIQUID SPRAY APPARATUS INCORPORATING SUCH A PUMP

[75] Inventor: Jacobus P. Jacobs, Transvaal, South Africa

[73] Assignee: Caraid Patents N.V., Willemstad, Netherlands Antilles

[21] Appl. No.: 229,059

[22] Filed: Jan. 28, 1981

[30] Foreign Application Priority Data

Jan. 30, 1980 [ZA] South Africa ..... 80/0561

[51] Int. Cl.[3] ..... B05B 9/08

[52] U.S. Cl. ..... 239/153; 239/373; 417/472

[58] Field of Search ..... 239/152, 153, 154, 373; 417/472; 92/34

[56] References Cited

U.S. PATENT DOCUMENTS

| | | | |
|---|---|---|---|
| 1,071,876 | 9/1913 | Campau | 239/152 |
| 2,844,102 | 7/1958 | Oishei | 239/284 R |
| 2,845,032 | 7/1958 | Krohm . | |
| 3,818,806 | 6/1974 | Fumagalli | 417/472 |

FOREIGN PATENT DOCUMENTS

| | | | |
|---|---|---|---|
| 879851 | 8/1979 | Belgium | 239/152 |
| 359721 | 9/1922 | Fed. Rep. of Germany . | |
| 513561 | 11/1930 | Fed. Rep. of Germany . | |
| 949213 | 9/1956 | Fed. Rep. of Germany . | |
| 725316 | 5/1932 | France | 417/472 |
| 1377945 | 12/1963 | France | 417/472 |
| 875851 | 4/1979 | France . | |
| 497476 | 12/1938 | United Kingdom . | |
| 798819 | 7/1958 | United Kingdom . | |
| 1335407 | 10/1973 | United Kingdom | 417/472 |
| 509730 | 9/1976 | U.S.S.R. | 417/472 |
| 578487 | 11/1977 | U.S.S.R. | 417/472 |

*Primary Examiner*—John J. Love
*Assistant Examiner*—Michael J. Forman
*Attorney, Agent, or Firm*—Kemon & Estabrook

[57] ABSTRACT

Co-operating formations (28 and 29) are provided within the chamber formed by a resiliently deformable air pump body (13) which has concertina sidewalls (23) so that the enclosure surrounded by the sidewalls (23) is substantially filled by the formations (28 and 29) when it is collapsed.

6 Claims, 7 Drawing Figures

GASEOUS FLUID PUMP AND LIQUID SPRAY APPARATUS INCORPORATING SUCH A PUMP

This invention relates to a gaseous fluid pump comprising a resiliently deformable body which forms a variable volume pump chamber wherein a pumping action is created by causing resiliently flexible contraction of the body and thereafter allowing it to expand again to draw in a fresh supply of fluid to be pumped. This invention also relates to liquid spray apparatus incorporating at least one such pump.

Clearly a pump arrangement of the above-mentioned type would embody one-way valves permitting the flow of fluid into the chamber via one passage and out of the chamber via another and these two passages could, of course, be made into one for a certain portion of their length.

The invention is particularly concerned with the provision of a pump which is suitable for use in an application where it is attached to the underside of a person's foot so that weight exerted on the foot will cause contraction of the pump chamber and release of such weight will enable the chamber to resume its enlarged volumetric capacity to draw fluid into it again. In general such pumps are employed in liquid spray apparatus for pumping air into containers of spray liquid wherefrom the liquid can be expelled, under pressure, from the lower region of the container. Liquid Spray Apparatus including two such pumps is described and claimed in the specification of United States Patent application Serial No. 33,381 dated 26th Apr. 1979.

It has been found that only a relatively low ultimate pressure can be generated in the liquid container of liquid spray apparatus as described in the above application. In some applications it may be desired to provided a higher pressure, and therefore, the object of this invention is to provide a pump of the general type described but wherein a higher compression ratio can be achieved and therefore ultimately higher pressures can be generated in the liquid container of the liquid spray apparatus.

This invention arises from the realisation that the difficulty experienced in generating adequate pressures in the liquid container of liquid spray apparatus as described in the specification referred to above follows from the fact that the sidewalls of the pump body, being of concertina shape and formed of an elastomeric material having substantial thickness, can only be contracted to a certain extent and thus an appreciable space remains in the interior of the pump body when it is fully collapsed, that space being the enclosure that is surrounded by the fully collapsed sidewalls.

According to one aspect of this invention there is provided a gaseous fluid pump comprising a resiliently deformable body which forms a variable volume pump chamber, said body including resiliently flexible sidewalls of a substantially concertina configuration collapsible in a direction transverse to that in which the concertina configurations extend in order to reduce the volumetric capacity of the chamber and displace gaseous fluid therefrom, said sidewalls being formed of a material having a thickness such that said sidewalls surround an enclosure when they are fully collapsed, wherein at least one formation which occupies at least part of said enclosure when said sidewalls are collapsed is provided within the pump chamber.

Provision of at least one such formation results in the volume of the space that remains in the enclosure when the pump body is fully collapsed being less than it would be if no such formation was provided with the result that the compression ratio is increased, and provides the facility for filling substantially the whole of the enclosure when the pump body is fully collapsed, if desired.

Preferably there are two such formations which co-operate together to occupy at least part of said pump chamber when said sidewalls are collapsed, one of said formations defining a protrusion co-operable with a complementary recess in the other of said formations.

According to another aspect of this invention there is provided liquid spray apparatus comprising a portable tank for containing liquid to be sprayed and adapted to be carried by an operator, and at least one air pump comprising a resiliently deformable body which forms a variable volume chamber and, for said chamber, means forming an air inlet opening which is in communication with ambient atmosphere and an air outlet opening which is connected to the interior of the tank, said body including resiliently flexible sidewalls of a substantially concertina configuration collapsible in a direction transverse to that in which the concertina configurations extend in order to reduce the volumetric capacity of the chamber and displace air therefrom through said outlet opening to pressurise the tank, said sidewalls being formed of a material having a thickness such that said sidewalls surround an enclosure when they are fully collapsed, and securing means for securing the chamber under a foot of a wearer in such a way that, by the heel to toe engagement of the respective foot with the ground as he walks, the wearer causes successive compression and expansion of the internal volume of the chamber by successively loading the chamber to collapse the concertina configurations by applying his mass to it and unloading the chamber, wherein at least one formation which occupies at least part of said enclosure when said sidewalls are fully collapsed is provided within the pump chamber.

Preferably the at least one formation comprises a projection which projects into said pump chamber from an end wall which is formed by said pump body at the lower end of said sidewalls, said end wall being the part of said body that engages the ground during the heel to toe engagement of the respective foot with the ground as the wearer walks. The strength and wear resistance of the ground engaging bottom portion of the pump body are increased by the provision of such a projection which is formed integrally with it, as is the integrity of the pump chamber since the risk that the bottom end wall might be penetrated by sharp objects, such as thorns, is reduced. It is, however, difficult to form as a one-piece moulding a pump body with such a projection which is sufficiently large to fill substantially the whole of said enclosure when the pump body is fully collapsed. Accordingly it is preferred that said at least one formation also includes another formation which projects into said pump chamber from the upper end thereof. Conveniently one of the two formations, preferably said projection, defines a protrusion co-operable with a complementary recess in the other of the two formations. Such an arrangement serves to centre the ground engaging end wall and its projection relative to the sidewalls and the other formation and avoids the danger of convolutions being trapped between the two formations as the pump body is being collapsed, thus catering for the fact that everyone's gait is different. Preferably the other formation forms a continuous peripheral wall which surrounds said recess and the platform configuration of the outer periphery of said other formation is substantially the same as that of the inner edges of the concertina configurations when the sidewalls are fully collapsed. Conveniently the dimensions of the projection and of the complementary recess are such that the projection can be substantially wholly received within the recess when the sidewalls are fully collapsed so that said enclosure is substantially filled by said formations when the sidewalls are fully collapsed.

In a preferred form of the apparatus in which this invention is embodied the body is a circular cylindrical body having an outwardly directed flange at its upper end which is open and which is made of an elastomeric material, and said other formation is formed by an insert which is fitted into the open end of the body, there being a substantially rigid footpiece which is arranged to be attached to the underside of a wearer's footwear by said securing means, and a rigid outer ring, the flange being secured to said footpiece with the aid of said outer ring so that the body is secured to the footpiece with the insert abutting the footpiece. Conveniently the means forming an air inlet opening and an air outlet opening comprise an aperture formed through said insert and grooves formed in one of a pair of abutting faces of said insert and said footpiece so as to be in communication with said aperture, there being one or more spigot connections for a tube formed in said footpiece and in communication with said grooves.

One form of liquid spray apparatus in which this invention is embodied will be described now by way of example with reference to the accompanying drawings, of which:

Figure 1:
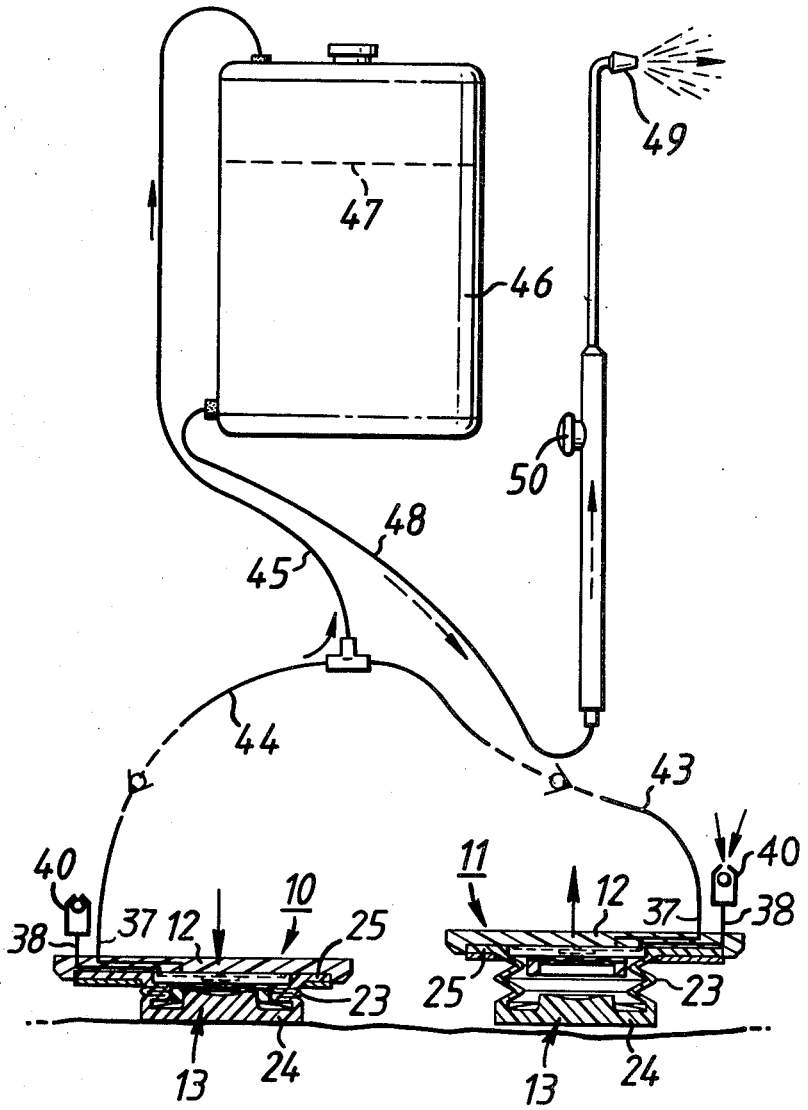
FIG. 1 is a diagrammatic illustration of the apparatus.
Figure 2:
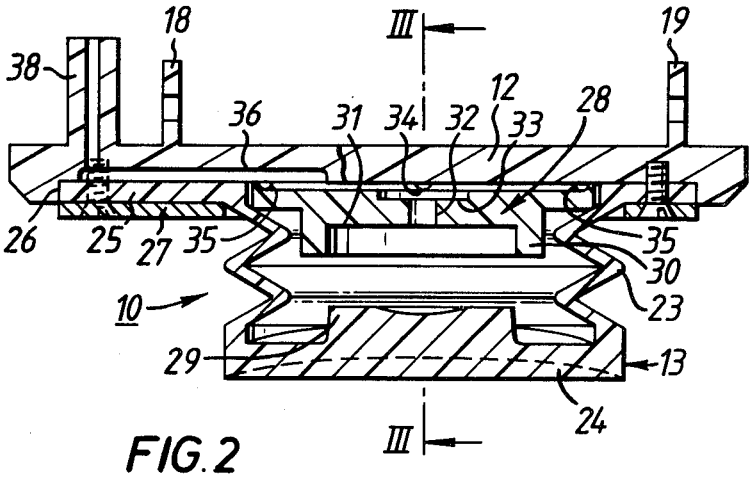
FIG. 2 is a partly-offset transverse cross-section of the left foot pump of the apparatus shown in FIG. 1 and is drawn to a larger scale than FIG. 1.

FIG. 1 shows that the apparatus includes two foot pumps which are indicated generally at 10 and 11. They are substantially similar, although of opposite hands. The pump 10 is now described in detail and corresponding parts of the foot pump 11 are identified in the following description and in the drawings by the same characters.

The foot pump 10 comprises a rigid injection moulded foot-plate 12 and a deformable body 13. The foot-plate 12 is adapted to be fitted under a shoe 14 (see FIGS. 3 to 7) worn by the operator so that the body 13 depends from it. FIGS. 2 to 7 show that the upper surface of the foot-plate 12 has locating formations formed on it, one 15, being a cross bar which is adapted to be abutted by the front edge of the heel 16 of the shoe 14, another 17 being an arcuate rim which receives the sides and rear of the heel 16, and the others 18 and 19 being side stops which are adapted to engage opposite sides of the sole 20 of the shoe 14 in the region of the instep. The length of the foot-plate 12 is such that, when worn, it spans the instep portion of the shoe 14 and abuts the sole 20 just behind the ball of the foot on which the shoe 14 is worn. Straps 21 and 22 (FIG. 4) are provided for securing the foot pump 10 to the shoe 14 with the foot-plate 12 located relative to the heel 16 and sole 20 by engagement of the formations 15, 17, 18 and 19 around the heel 16 and the sole 20.

Figure 4:
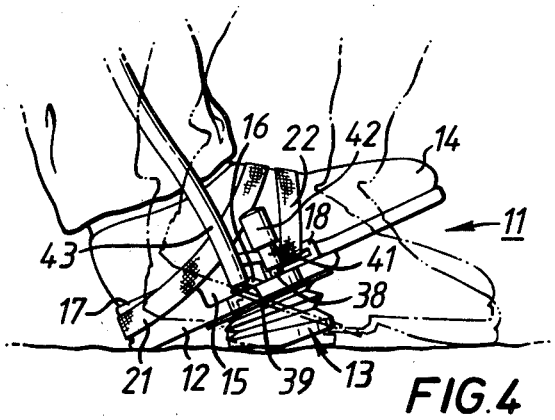
FIG. 4 is a side view of the right foot pump as worn in use and illustrates its operation by the heel to toe action of the operator's foot as he walks.
Figure 3:
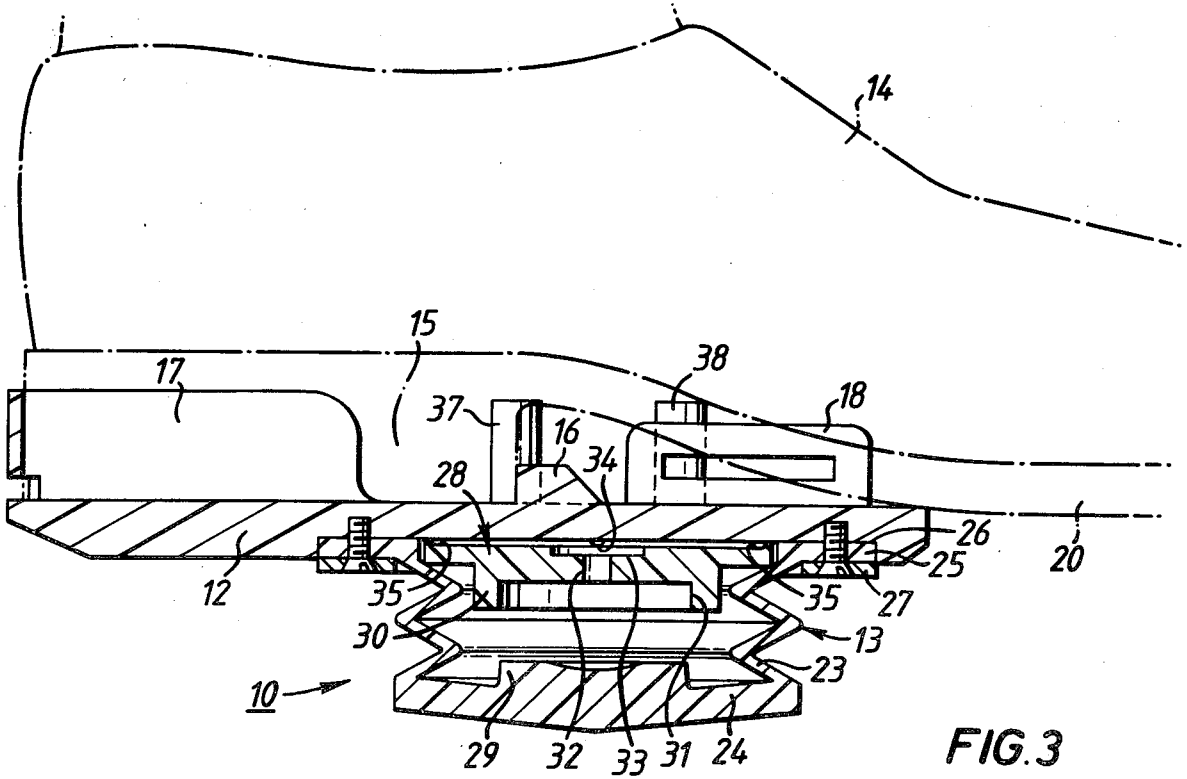
FIG. 3 is a section on the line III—III in FIG. 2 of the foot pump indicating its location relative to a shoe to which it is fitted, the shoe being shown in chain-dotted lines.
Figure 5:
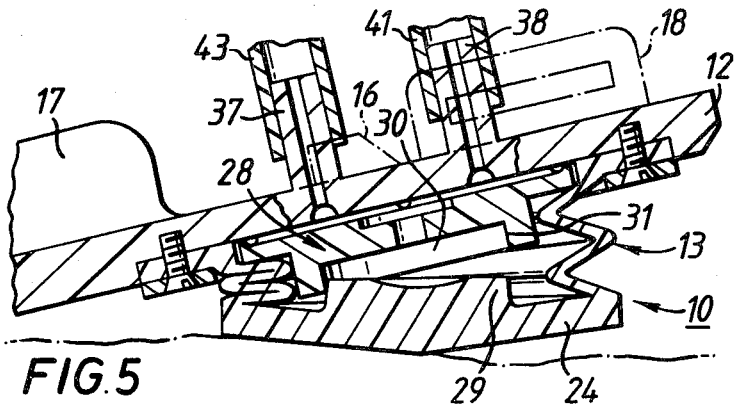
FIGS. 5, 6 and 7 illustrate the manner in which each foot pump is actuated by the foot of the operator on which it is worn as the operator walks.

The deformable body 13 is a one-piece moulding of polyurethane. FIGS. 3 and 4 show that it comprises a circular side wall 23 and an integral end wall 24 at its lower end. The underside of the end wall 24 tapers downwardly to a transversely-extending ridge. The deformable body 13 also has a radially outwardly directed peripheral flange 25 formed at its upper end. The flange 25 is received snugly in a circular recess 26, which is formed in the underside of the foot-plate 12, and is clamped in position in an air-tight manner by a clamp ring 27 which is screwed to the foot-plate 12. The flange 25 and the ring 27 are substantially of constant width around the entire periphery of the body 13 apart from the one side shown in FIG. 2 whereat the foot-plate 12 and the flange 25 are extended laterally outwards. The side wall 23 is convoluted so that it has a concertina configuration. An insert 28 is trapped between the top concertina configuration and the foot-plate 12 so that it forms the other end wall of the cylindrical chamber formed within the body 13.

An inwardly-directed projection 29 is formed on the upper surface of the end wall 24. The projection 29 is located centrally in the end wall 24, has a saucer-shaped recess formed at the centre of its upper surface, and leaves sufficient space between its outer periphery and the nearer annular peripheral portions of the concertina configurations of the side wall 23 to receive a depending annular projection 30 which is formed by the bottom of the insert 28. The annular projection 30 surrounds a central recess 31 which is complementary to the projection 29 and is therefor adapted for receiving the projection 29. The insert 28 and the projection 29 are formations which are designed to co-operate so that when the pump body 13 is in a fully collapsed condition, only a small portion of its volumetric capacity remains thereby providing a large compression ratio relative to the volumetric capacity when it is in a fully extended or relaxed condition.

A central hole 32 through the insert 28 communicates with a recess 33 which is formed by the surface of the insert 28 that abuts the foot-plate 12 and which in turn communicates with a radical groove 34 provided in that surface of the insert 28 which engages the foot-plate 12. The diameter of the central hole 32 is less than that of the saucer-shaped recess in the upper surface of the projection 29. This radial groove 34 in turn communicates with a peripheral groove 35 in the insert 28 which in turn communicates with transverse grooves 36 in the undersurface of the foot-plate 12. Finally, the transverse grooves 36 communicate with a pair of tubular spigots 37 and 38 which are formed integrally with the moulded foot-plate 12.

Each of the tubular spigots 37 and 38 has a non-return valve 39, 40 force fitted into its upper end. The valve 39 fitted into the spigot 37 permits displacement of air from the interior of the chamber that is formed by the body 13 and the insert 28 via the central hole 32, the recess 33, the grooves 34, 35 and 36 and the spigot 37, but prevents backflow to the interior of that chamber. The valve 40 fitted into the spigot 38 allows induction of air into the interior of the chamber that is formed by the body 13 and the insert 28 via a path formed by the spigot 38, the grooves 36, 35 and 34, the recess 33 and the central hole 32, and prevents exhaust in the opposite direction along that path.

The recess 26 is located such that the central axis of the circular hollow body 13 extends between the ball of the foot on which the shoe 14 is worn and the base of the heel of that foot. Hence the axis of the circular body 13 is substantially in line with the lower leg portion by which the operator's weight is transmitted to his foot when that foot is grounded.

The polyurethane material selected for moulding to form the body 13 is a wear resistant resilient material which has good shape memory characteristics as well as being impermeable to air. Hence, due to the inherent resilience of the polyurethane material, the cushion reassumes its preloaded form or shape after release of an applied load that deformed it from that preloaded form or shape. Any other suitable elastomeric material may be used.

FIG. 4 shows that the tubular spigot 38 is spigotted into a short flexible pipe 41 which extends to just above the shoe 14. An air filter 42 is fitted to the upper end of the pipe 41.

The other tubular spigots 37 of the two pumps 10 and 11 are connected via flexible pipes 43 and 44 to a common conduit 45 which feeds via a non-return valve (not shown) into a spray liquid reservoir tank 46 of the haversack type which contains spray liquid to the level 47. The reservoir tank 46 has a delivery conduit 48 leading to a spray head 49 via a control valve 50. The tank 46 is provided with a suitable vent valve.

In use of the apparatus to spray plants, an operator carries the haversack type tank 46 on his back and wears the pumps 10 and 11 strapped under his left and right shoes 14 respectively.

The pumps 10 and 11 are operated alternately as the operator walks, the hollow body 13 of the pump 10, 11 under the shoe 14 that is grounded being compressed by the mass of the operator whilst the body 13 of the other pump 10, 11 is in its expanded state until the respective foot is next placed on the ground.

Figure 6:
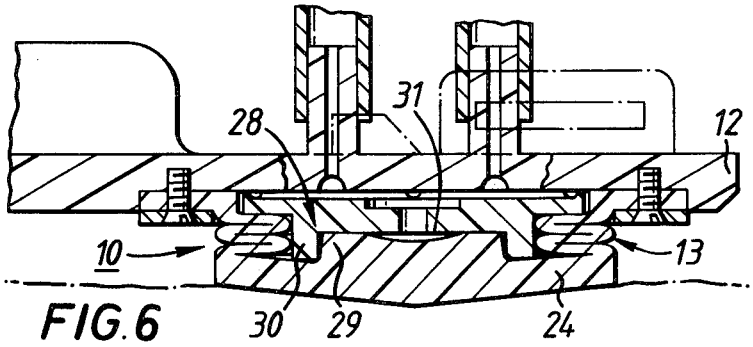
Figure 7:
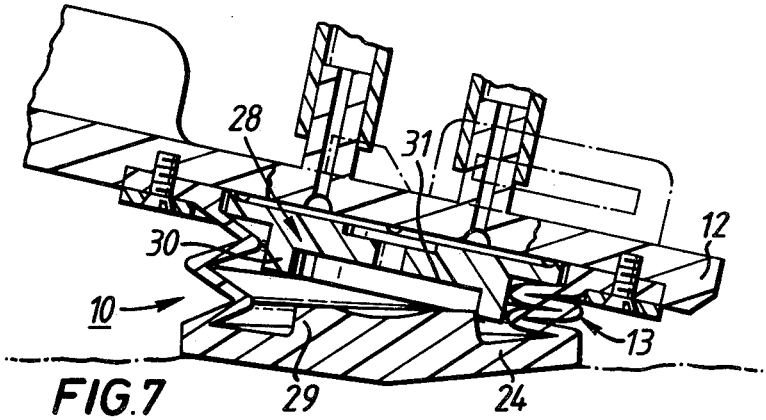

Successive compression and expansion of each pump 10, 11 during the heel to toe movement of the respective foot that is grounded during walking is illustrated in FIGS. 4 to 7. Initial contact of the shoe 14 with the ground is made by the lower rear edge of the heel 16, as shown in FIG. 4, and that is preceded by contact of the lower end wall 24 of the respective body 13 so that compression of that body 13 began just before the initial contact of the heel 16 with the ground. The shoe 14 is then pivoted about the heel 16 to bring the sole 20 of the shoe 14 to the ground when, as shown in FIG. 6, compression of the body 13 is complete. In this condition, the projection 29 is received within the central recess 31 of the insert 28 with that part of its upper surface that surrounds its saucer-shaped recess abutting the base of the central recess 31 around the mouth of the central hole 32, the rim of the annular projection 30 abuts the inner surface of the end wall 24 that surrounds the base of the projection 29 and the concertina convolutions of the sidewalls 23 which are compressed have their inner circumferentially extending edges in contact with the outer surface of the insert 28. Hence the enclosure that is surrounded by the sidewalls 23 is substantially filled by the insert 28 and the projection 29. The heel 16 is then lifted so that expansion of the body 13 begins as shown in FIG. 7 and that expansion continues until first the sole 20, and then the cushion 13 itself has been lifted from the ground.

FIG. 1 shows that air within the body 13 is displaced from the body 13 to the pipe 41 as the body 13 is compressed, whilst ambient air is drawn into the interior of that body 13, via the pipe 41 as the body 13 expands. Alternate compression and expansion of the two hollow bodies 13 causes air to be pumped into the space above the liquid level 47. The pressure in this space will increase and will place the spray liquid under pressure in the reservoir tank 46. Operation of the valve 50 will result in liquid being sprayed from the spray head 49 under the pressure inside the reservoir tank 46.

Thus, as can be seen from FIG. 1, the spray liquid issues in a spray from the spray head 49 and is directed under pressure onto the leaves of a plant.

The non-return valves fitted into the tubular spigots 37 and 38, the insert 28 and the hollow body 13 are replaceable.

It is not essential for the operator to walk to pressurise the reservoir tank. He could remain in one spot and simply raise and lower his feet to actuate one or both of the pumps 10 and 11.

I claim:

1. A gaseous fluid pump for a liquid spray apparatus including a portable tank containing liquid to be sprayed and adapted to be carried by an operator, said pump comprising a resilient deformable body including flexible sidewalls of a substantially concertina configuration having convolutions and an end wall at a lower end of said sidewalls forming a variable volume chamber, a footplate, said body terminating in a peripheral flange, means securing said flange and body to said footplate, said footplate having an air inlet opening with a check valve providing flow of ambient atmosphere into said chamber and an air outlet opening having a check valve providing air flow from said chamber, conduit means connected to said outlet opening and communicating with said tank, said body collapsible in a direction towards said footplate in order to reduce the volumetric capacity of said chamber and displace air therefrom to pressurize said tank, said footplate securing said body under a foot of a wearer in such a way that, by the heel to toe engagement of the respective foot with the ground as he walks, the wearer causes successive compression and expansion of the internal volume of the chamber by successively loading the chamber to collapse the concertina configuration by applying his mass to it and unloading the chamber, a projection in said chamber extending from said end wall which is formed by said pump body at the lower end of said sidewall, said end wall being the part of said body that engages the ground during the heel to toe engagement of the respective foot with the ground as the wearer walks, said chamber including a depending projection which extends into said chamber from the upper end thereof, said depending projection defining a recess cooperable with said projection, said depending projection having an aperture therein providing communication between said deformable body and said inlet and outlet openings, said depending projection constituting a continuous peripheral wall defining said recess for receiving said projection therein with the concertina convolutions of said deformable body having their inner circumferentially extending edges in contact with the outer surface of said depending projection when said body is collapsed.

2. A gaseous fluid pump for a liquid spray apparatus as set forth in claim 1 wherein said projection and said depending projection are disposed in spaced relation to one another when said deformable body is in an uncompressed state.

3. A gaseous fluid pump for a liquid spray apparatus as claimed in claim 1 wherein said first named means constitutes an outer ring for securing said peripheral flange to said footplate.

4. A gaseous fluid pump for a liquid spray apparatus as claimed in claim 1 wherein said deformable body includes an insert interposed between said footplate and the top of the concertina configuration and constituting the other end wall of said chamber, said insert having said depending projection formed thereon.

5. A gaseous fluid pump for a liquid spray apparatus as claimed in claim 4 wherein said insert is provided with a further recess formed in the surface of said insert that is engageable with said footplate having an aperture therein communicating with said first mentioned recess, said projection having a recess formed at the center of its upper surface which registers with said insert aperture upon the compression of said deformable body.

6. A gaseous fluid pump for a liquid spray apparatus as claimed in claim 5 wherein said footplate having grooves formed in the under surface thereof, wherein said air inlet and outlet openings comprise a pair of spigots mounted on said footplate and communicating with said grooves in said footplate, and grooves formed in said insert and communicating with said further recess and said grooves in said footplate.

* * * * *